US010668605B2

(12) United States Patent
Pressnell

(10) Patent No.: US 10,668,605 B2
(45) Date of Patent: Jun. 2, 2020

(54) GASKET INSTALLATION TOOL

(71) Applicant: Tyco Fire Products LP, Lansdale, PA (US)

(72) Inventor: Kevin W. Pressnell, Athens, AL (US)

(73) Assignee: Tyco Fire Products LP, Lansdale, PA (US)

( * ) Notice: Subject to any disclaimer, the term of this patent is extended or adjusted under 35 U.S.C. 154(b) by 54 days.

(21) Appl. No.: 15/888,524

(22) Filed: Feb. 5, 2018

(65) Prior Publication Data

US 2018/0222027 A1 Aug. 9, 2018

Related U.S. Application Data

(60) Provisional application No. 62/455,902, filed on Feb. 7, 2017.

(51) Int. Cl.

| | |
|---|---|
| ***B25B 27/28*** | (2006.01) |
| ***B25B 27/02*** | (2006.01) |
| ***B05B 15/65*** | (2018.01) |
| *A62C 35/68* | (2006.01) |

(52) U.S. Cl.

CPC ..... *B25B 27/28* (2013.01); *B25B 27/023* (2013.01); *A62C 35/68* (2013.01); *B05B 15/65* (2018.02)

(58) Field of Classification Search

CPC . B25B 27/00; B25B 27/0028; B25B 27/0092; B25B 27/10; B25B 27/28; Y10T 29/53883; Y10T 29/53909

See application file for complete search history.

(56) References Cited

U.S. PATENT DOCUMENTS 2,036,782 A * 4/1936 Ullmo ..... B25B 27/062 29/263
2,357,139 A * 8/1944 Seme ..... B25B 27/20 29/229
3,289,286 A * 12/1966 Belanger ..... B25B 27/0028 29/235
4,005,883 A * 2/1977 Guest ..... F16L 37/0845 285/322
4,141,129 A * 2/1979 Martini ..... B23P 19/084 29/235
5,519,929 A * 5/1996 Bleckman ..... B25B 27/023 29/264

(Continued)

FOREIGN PATENT DOCUMENTS

WO WO 2017/214418 12/2017

OTHER PUBLICATIONS

IFW, U.S. Appl. No. 62/455,902, filed Feb. 7, 2017, 82 pages.

*Primary Examiner* — Tyrone V Hall, Jr.
(74) *Attorney, Agent, or Firm* — Foley & Lardner LLP

(57) ABSTRACT

A gasket installation tool for installing a gasket member within an internal gasket chamber of a sprinkler head adapter or fitting. The installation tool includes a tubular assembly that engages the sprinkler head fitting and provides a passageway into which the gasket member is loaded. A rod member engaged with the tubular assembly advances the gasket member through the passageway of the tubular assembly to radially compress the gasket member. The engagement between the rod member and the tubular assembly controls the advancement of the gasket member into the fitting to properly locate the gasket within the chamber and prevent over travel.

10 Claims, 5 Drawing Sheets

(56) References Cited

U.S. PATENT DOCUMENTS

| | | | | |
|---|---|---|---|---|
| 5,956,830 | A * | 9/1999 | Imbus | B23P 19/084 29/229 |
| 8,297,663 | B2 | 10/2012 | Spears | |
| 2005/0126000 | A1 * | 6/2005 | Hadayia, Jr. | B25B 27/0028 29/888.01 |

* cited by examiner

GASKET INSTALLATION TOOL

PRIORITY CLAIM & INCORPORATION BY REFERENCE

This application claims the benefit of priority to U.S. Provisional Application No. 62/455,902, filed Feb. 7, 2017, which is incorporated by reference in its entirety.

TECHNICAL FIELD

The present invention relates generally to tools for assembly and/or installation of fire protection devices, sprinkler assemblies or components. More specifically, the present invention is directed to a tool for the installation of an internal gasket member of a fire protection sprinkler head adapter fitting.

BACKGROUND ART

Pipe fittings used in the installation of fire protection sprinklers are well known. Generally, fire protection sprinklers or sprinkler heads include a sprinkler frame body with an inlet end having an external pipe thread for forming a threaded pipe connection with a supply pipe of firefighting fluid, such as for example, water and an outlet end for discharging the fluid to address a fire. There are sprinkler head fittings or adapters which couple the sprinkler head to the supply pipes of firefighting fluid. One type of sprinkler fitting is shown in U.S. Pat. No. 8,297,663, which describes the fire sprinkler fitting as having one end for connection to a fluid supply pipe and an end for receiving a fire sprinkler with an internal gasket to form a fluid tight seal with the sprinkler end.

Another sprinkler head adapter or fitting is shown in PCT Patent Application Publication No. WO2017/214418, entitled "Sprinkler Head Adapter," and which is incorporated by reference in its entirety. The sprinkler adapter described therein includes a housing having a first end for connection to a firefighting fluid supply pipe, an internal passageway and a second end for engagement with a fire protection sprinkler. The internal passageway also includes a gasket chamber with a gasket disposed therein. For this type or similar sprinkler adapter, the internal gasket may need to be replaced from time to time. This process involves removing the sprinkler head from the fitting, removing the deformed internal gasket and replacing the gasket with a new one. In the case of a sprinkler head fitting installed in the field, the sprinkler head fitting may be in a fixed orientation or location which can make gasket replacement difficult. Accordingly, there is a need for a gasket installation tool that can deliver and properly locate a gasket within the sprinkler head fitting.

DISCLOSURE OF INVENTION

The present invention is directed to a preferred gasket installation tool for installing a gasket member within a fluid supply pipe or fitting. More preferably, a gasket installation tool is provided for installing an annular gasket member within an internal gasket chamber of a sprinkler head adapter or fitting. The preferred installation tool includes a tubular assembly that engages the sprinkler head fitting and provides a passageway into which the gasket member is loaded. A rod member engaged with the tubular assembly advances the gasket member through the passageway of the tubular assembly to radially compress the gasket member.

The rod member axially advances the gasket member and ejects the gasket member from the tubular assembly for introduction into the sprinkler head fitting. The engagement between the rod member and the tubular assembly controls the advancement of the gasket member into the fitting to properly locate the gasket within the chamber and prevent over travel.

A preferred gasket installation tool for installing a gasket in an internal chamber of a sprinkler head fitting includes a rod member for having a first end and a second end and a tubular assembly for engaging the fitting. The tubular assembly has an inlet and an outlet with the tubular assembly defining a passageway extending from the inlet to the outlet along a longitudinal axis. The passageway preferably includes a radial loading first portion to which the gasket is loaded and a second portion for housing the gasket proximate the outlet. The rod member is preferably received within the passageway for axial translation along the passageway to displace the gasket out of the passageway through the outlet and into the internal chamber of the fitting.

Another preferred gasket installation tool is provided for installing a gasket in an internal chamber of a sprinkler head fitting having a body member and a cap member coupled to one another to form a gasket chamber therebetween. The installation tool includes a housing component having a first end for engaging the cap member and a second end for receiving a gasket member. The housing component preferably has a tapered internal passageway extending from the first end to the second end along a longitudinal axis. A ring component is preferably coupled to the housing component. The ring component preferably has an internal thread on an internal surface defining a central opening axially aligned with the internal passageway of the housing component. The installation tool preferably includes a rod member having a first end and a second end with an external thread between the first end and the second end to engage the internal thread of the ring component such that the first end supports the gasket within the internal passageway of the housing for delivery to the gasket chamber of the fitting.

A preferred method of installing a gasket in an internal chamber of a sprinkler head is provided. The preferred method includes radially loading the gasket within an intermediate portion of an internal passageway of a tubular assembly; and axially translating a rod member through the internal passageway to displace the gasket from the internal passageway and into position within the internal chamber of the sprinkler head fitting.

BRIEF DESCRIPTION OF DRAWINGS

The accompanying drawings, which are incorporated herein and constitute part of this specification, illustrate exemplary embodiments of the invention, and together, with the general description given above and the detailed description given below, serve to explain the features of the invention. It should be understood that the preferred embodiments are some examples of the invention as provided by the appended claims.

MODE(S) FOR CARRYING OUT THE INVENTION

Figure 1:
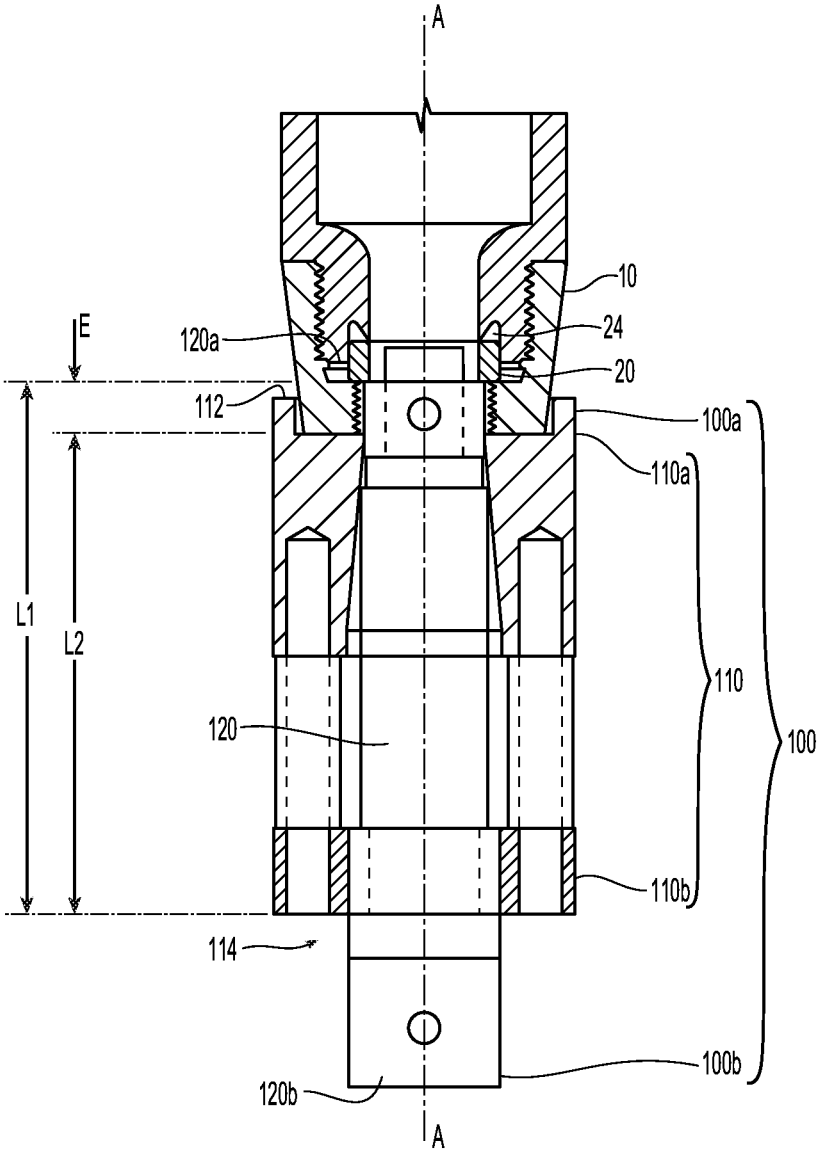
FIG. 1 is a partial cross-sectional view of a preferred gasket installation tool engaged with an exemplary fire protection sprinkler head fitting.
Figure 2A:
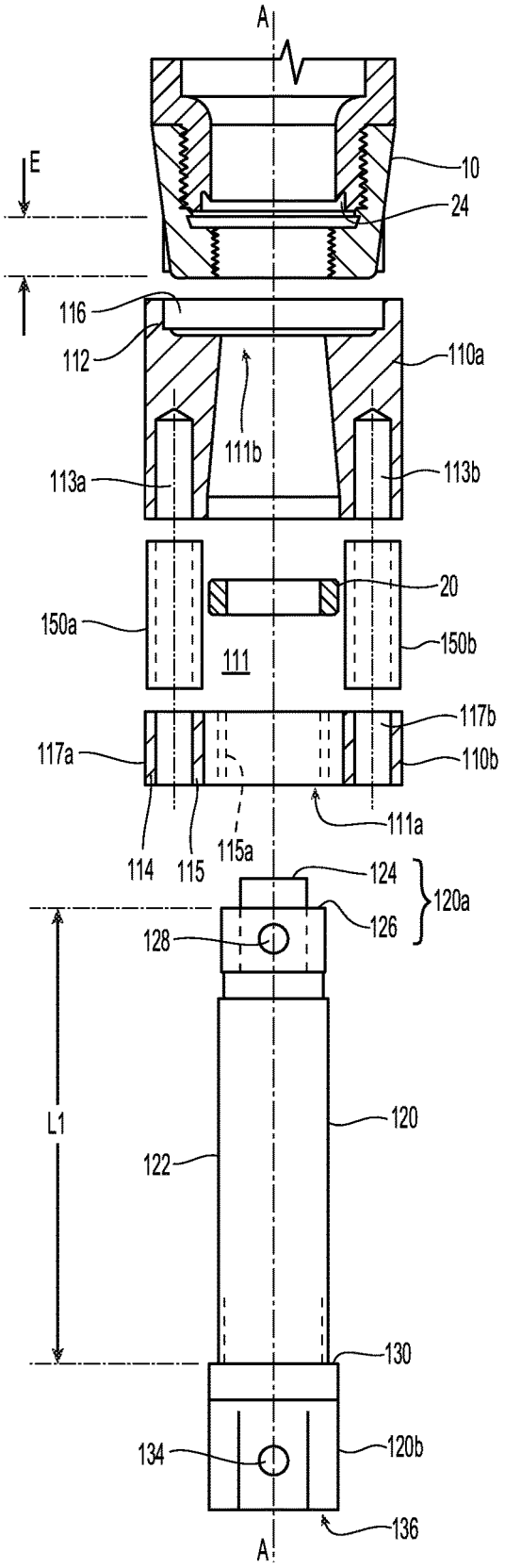
FIG. 2A is an exploded partial cross-sectional view of the gasket installation tool of FIG. 1.

Shown in FIG. 1 is a preferred tool assembly 100 engaged and coaxially aligned along axis A-A with an exemplary fire protection sprinkler head fitting or adapter 10 to install an annular gasket or seal 20 within a gasket chamber 24 of the fitting 10. The tool assembly 100 has a first end 100*a* engaged with the fitting 10 and a second end 100*b* that is manipulated by hand or tool for positioning the gasket 20 within the chamber 24. In the preferred embodiment shown, the installation tool 100 generally includes a tubular assembly 110 of one or more members providing one end 112 configured for engaging the adapter 10 and a second end 114 for receiving a rod member 120. The rod member 120 is disposed within the tubular assembly 110 and translates within the assembly 110. With reference to FIG. 2A, the rod member 120 preferably includes a first end 120*a* configured for engaging and supporting the gasket 20 to be inserted within the adapter 10 and a second end 120*b* configured for manipulation by hand or by a tool to translate and/or rotate the rod member 120 within the tubular assembly 110 in order to locate the gasket member 20 within the gasket chamber 24 of the adapter 10.

Figure 6A:
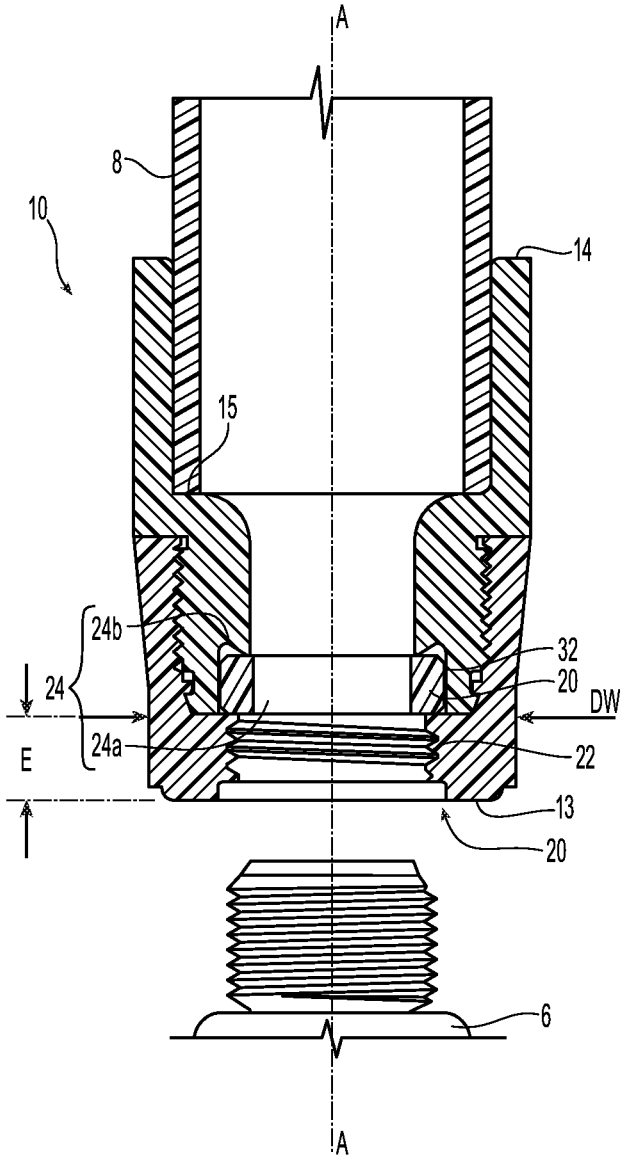
FIGS. 6A-6B are cross-sectional views of a preferred exemplary sprinkler head fitting for use with the installation tool of FIG. 1.
Figure 6B:
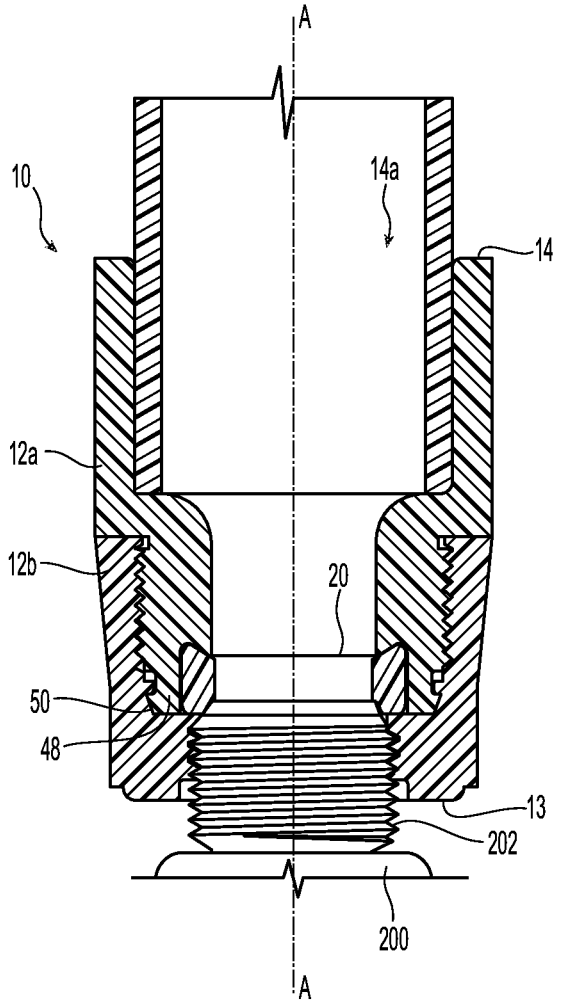

In a general operation of the tool assembly, the gasket 20 is coaxially centered within the tubular assembly 110 and radially compressed. The rod member 120 is inserted within the tubular member and axially translated to engage and support the gasket 20. By manipulating the rod member 120, the rod member 120 is preferably translated within the tubular assembly 110 to displace or transfer the gasket 20 from the tubular assembly 110 to the gasket chamber 24 of the adapter 10. The gasket 20 is preferably made of an elastomeric and compressible material suitable for forming a fluid tight seal. As described herein, the gasket is translated within a preferably internally tapered passageway portion of the tubular assembly 110. Axial travel within the tapered passageway radially compresses the gasket 20 for delivery into the adapter 10. Once located within the gasket chamber 24 of the adapter 10, the gasket 20 expands and is positioned to form a fluid tight seal with a sprinkler head received within the adapter or fitting 10. Preferred use of the installation tool 100 facilitates installation of the gasket member 20 within the fitting 10 installed in the field coupled to a fluid supply pipe 8 as seen for example in FIGS. 6A and 6B. Accordingly, the preferred installation tool is configured for replacing a gasket member in a sprinkler adapter installed in the field.

In a preferred embodiment of the installation tool, the tubular assembly 110 forms a preferred housing for each of the rod member 120 and the gasket 20. The tubular assembly 110 has an inlet 111*a* formed at the second end 114 and an outlet 111*b* formed at the first end 112 spaced apart from the inlet 111*a* to define a passageway 111 extending from the inlet to the outlet along a longitudinal axis A-A. The preferred passageway includes a portion for receiving and holding the gasket proximate the outlet and more preferably radially compressing the gasket for delivery to the gasket chamber 24 of a sprinkler fitting 10. The passageway 111 is also dimensioned and configured to allow for axial translation of the rod member 120 to deliver and locate the gasket 20 within the gasket chamber 24. Moreover, the rod member 120 preferably engages the tubular assembly 110 in a manner that provides for controlled location of the gasket 20 and more preferably limits and/or prevent over travel of the gasket 20 within the adapter 10.

In the preferred embodiment of FIG. 1, the tubular assembly 110 includes two components: a first housing component 110*a* and a second annular or ring component 110*b* that is coupled to the housing component 110*a*. The first housing component 110*a* has an internal surface that is preferably tapered narrowly in the direction from the inlet to the outlet. The tapered passageway of the housing component 110*a* defines a preferably conical portion of the passageway 111 in which the gasket 20 can be temporarily housed. As described, the rod member 120 engages the gasket and translates the gasket axially along the tapered passageway. With the preferably annular gasket oriented so as to be centered about the longitudinal axis A-A, the axial translation of the gasket 20 down the narrowing passageway radially compresses the gasket 20 for insertion into the adapter 10.

Figure 3A:
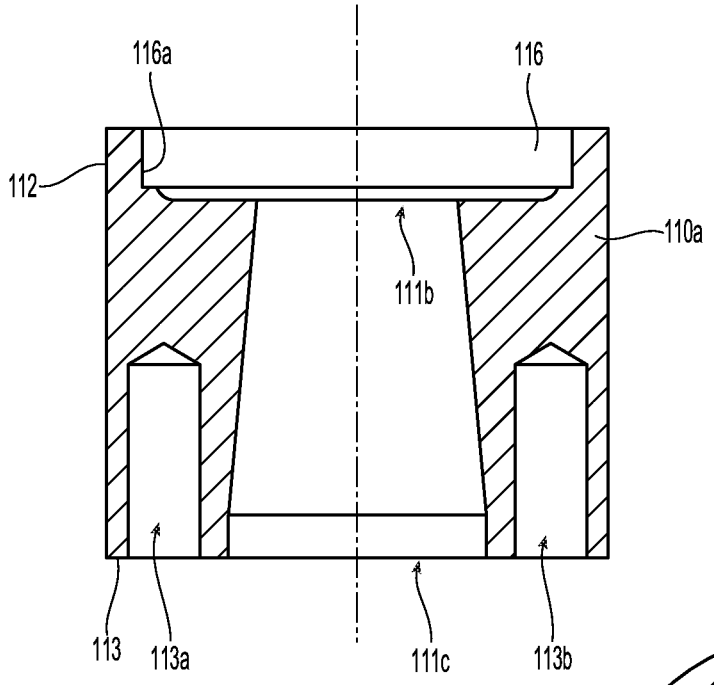
FIGS. 3A-3C are cross-sectional and end views of a preferred housing component for use in the gasket installation tool of FIG. 1.
Figure 3B:
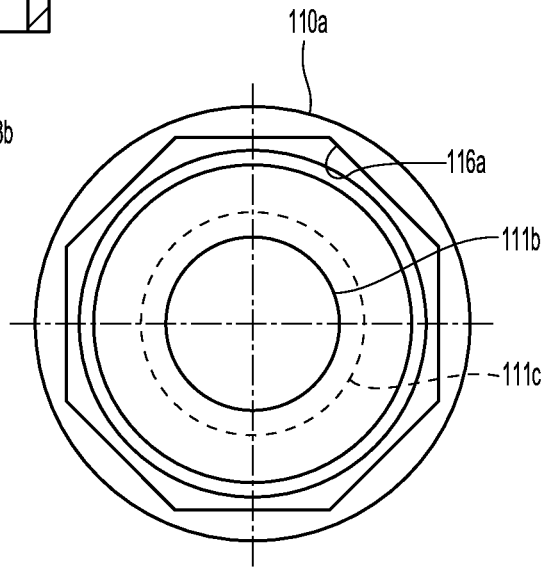
Figure 3C:
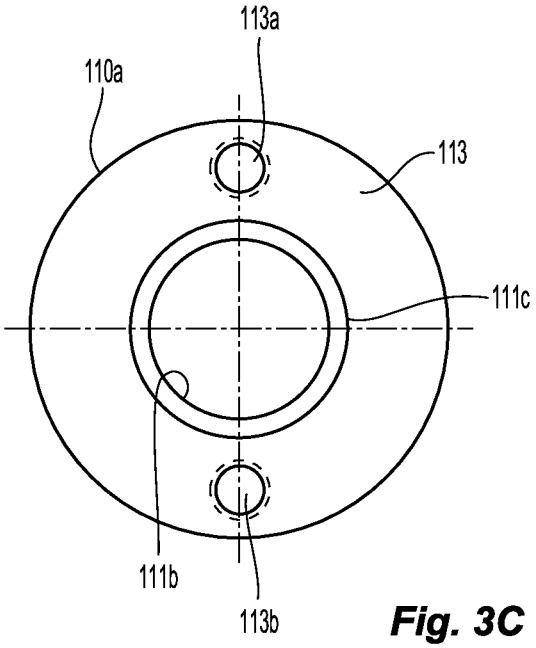

Referring now to FIGS. 2A and 3A are cross-sectional views of the housing component 110*a*. At the adapter engagement end 112 of the component 110*a*, a receptacle 116 is formed for receipt of the adapter 10 in a manner that aligns the passageway 111 of the installation tool 100 with the internal passageway of the adapter 10. The receptacle 116 is defined by a recessed surface 116*a* that is configured to engage an installed adapter 10 in a stable manner so as to prevent relative rotation between the adapter 10 and the tool 100 and maintain the passage alignment between the components 10, 100. As shown in FIG. 3B, the receptacle surface 116*a* includes a floor for abutting the end face of the fitting and a plurality of radially disposed flats for contact with complementary flat surfaces of the adapter 10. The outlet 111*b* of the housing component 110*a* is centrally formed at the center of floor of the receptacle 116. The outlet 111*b* is preferably dimensioned with a diameter that is smaller than the internal diameter of the passageway at the end of the adapter or fitting 10. The smaller diameter outlet 111*b* of the housing component 110*a* ensures that the gasket 20 is sufficiently radially compressed for insertion and expansion within the adapter 10. Shown in FIG. 3C is the end 113 of the housing component 110*a* opposite the receptacle 116. Formed at the housing end 113 is an intermediate opening 111*c* of the passageway 111. The intermediate opening 111*c* is formed sufficiently large to receive and orient the annular gasket 20 so as to be centered about the longitudinal axis A-A. Moreover, the differential sizing of the intermediate and outlet openings 111*b*, 111*c* allow for the tapered portion of the passageway 111 through the housing components 110*a*. Preferably formed diametrically about the intermediate opening 111*c* are partial or blind bores 113*a*, 113*b*. The bores 113*a*, 113*b* are preferably internally threaded to secure the preferred second ring component 110*b* to the housing component 110*a* using appropriately sized threaded bolts or fasteners (not shown).

Referring again to FIG. 2A, the second ring component 110*b* of the tubular assembly 110 is axially aligned with the first housing component 110*a*. The ring component 110*b* centers the rod member 120 through the tubular assembly preferably providing both axial and radial support. The preferred ring component 110*b* has an internal surface 115 which defines its central opening and the centralized inlet opening 111*a* at the second end 114 of the tubular assembly 110. The internal surface 115 preferably includes an internal thread 115*a* to engage a corresponding external thread of the rod member 120. The threaded engagement between the two components provides for controlled axial travel of the rod member 120 through the housing and limits the insertion travel of the gasket 20 into the adapter 10 in a manner as described herein. The internal surface 115 of the ring component 110*b* can include an alternate configuration to provide the desired engagement with the rod member. For example, the internal surface 115 can include a groove to engage a correspondingly configured tongue or rail on the rod member 120. Further in the alternative, the ring component 110*b* can include an internal bearing assembly, for example, a ball or roller bearing assembly to radially and axially support a shank portion of the rod member 120. Accordingly for preferred embodiments of the installation tool 100, a portion of the passageway 111 of the tool forms a rod engagement portion for supporting the rod member 120 axially and radially within the tubular assembly 110.

Figure 4A:
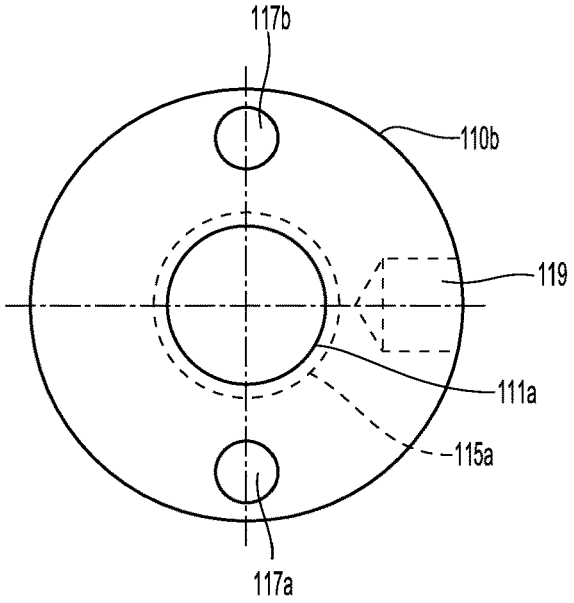
FIG. 4A-4B are end and cross-sectional views of a preferred ring member component for use in the gasket installation tool of FIG. 1.
Figure 4B:
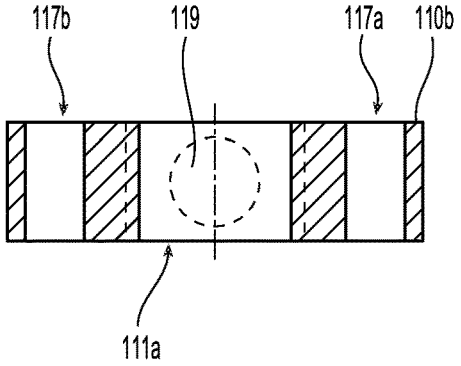

Referring to FIGS. 4A and 4B are various views of the preferred ring component 110*b*. Preferably diametrically opposed about the central inlet opening 111*a* of the ring component 110*b* are a pair of through bores 117*a*, 117*b*. The through bores 117*a*, 117*b* are preferably dimensioned and configured to axially align with the bores 113*a*, 113*b* of the first housing component 110*a*. Bolts or fasteners (not shown) are axially disposed through the axially aligned bores 113*a*, 113*b*, 117*a*, 117*b* to secure the first and second tubular components 110*a*, 110*b* to one another to form the assembly 110. In another preferred aspect, a lateral blind bore 119 is formed along the periphery of the ring member 110*b* to receive and secure a handle (not shown) to assist in handling and positioning of the installation tool 100. The handle can be secured within the lateral bore 119 by a threaded engagement or any other suitable form of temporary or permanent securement.

Figure 2B:
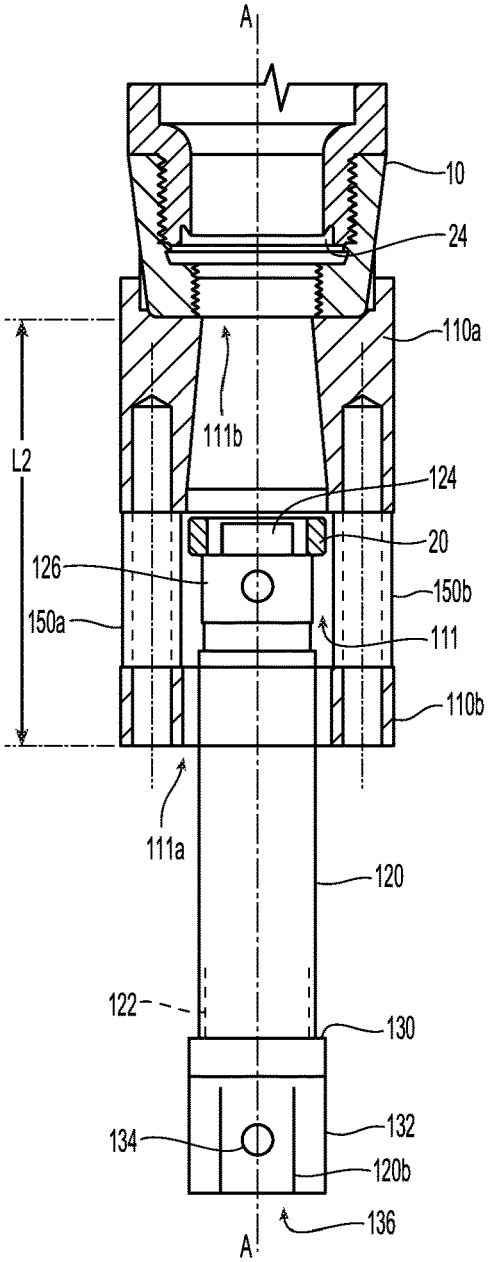
FIG. 2B is another partial cross-sectional view of the gasket installation tool of FIG. 1 engaged with the exemplary fire protection sprinkler adapter.

Referring to FIGS. 2A and 2B, it is desirable to have a portion of the passageway 111 laterally or radially accessible for loading of the gasket member 20. As shown in the assembled view of FIG. 2B, the gasket member 20 can be laterally or radially loaded in the passageway 111 in an exposed portion of the passageway 111 between the first housing component 110*a* and the second ring component 110*b*. With the gasket member 20 accessible in the passageway 111, the rod member 120 can be brought into engagement with the gasket member 20, as seen in FIG. 2B, for insertion into the first housing component 110*a* and delivery to the adapter 10 as seen in FIG. 1. To provide the preferably laterally or radially accessible portion of the passageway 111, the first housing component 110*a* is axially spaced from the second ring component 110*b*. In the preferred embodiment shown, the tool 100 includes one or more elongate spacers 150 and more preferably includes a pair of elongate spacers 150 secured between the first housing component 110*a* and the second ring component 110*b*. Each of the spacers 150*a*, 150*b* are preferably cylindrical tubular members for axial alignment with the bores 113*a*, 113*b* of the first housing component 110*a* and the bores 117*a*, 117*b* of the ring component 110*b*. Sufficiently sized and configured bolts or fasteners (not shown) are disposed through the bores and through the spacers 150*a*, 150*b* to secure the tubular assembly 110 together.

Shown in FIG. 2A is a preferred embodiment of the rod member 120. The first end 120*a* of the rod member 120 is configured for engaging the gasket member 20 and the second end 120*b* of the rod member 120 is configured for manipulation by hand or a tool. The rod member 120 includes an intermediate shank portion 122 between the first and second ends 120*a*, 120*b* of the rod member 120. The shank portion preferably includes an engagement formation or other structure for engagement with the tubular assembly 110 in a manner as previously described. For example, the intermediate shank portion 122 preferably includes a threaded portion for threaded engagement with the ring member 110*b*.

The first end 120*a* of the rod member 120 is preferably configured for orienting the annular gasket member 20 to be centered about the longitudinal axis A-A. In a preferred embodiment, the first end is preferably formed with a centering post 124 to engage the central opening of the annular gasket. Preferably disposed about the centering post 124 is a first stage or shelf 126. The shelf 126 can be formed integrally with the rod member 120 and the centering post 124. More preferably, the shelf 126 is separately formed and coupled to the centering post 124. Accordingly in the preferred embodiment shown FIG. 2A, the shelf 126 includes a bore 128 for permanently or temporarily securing the shelf 126 to the centering post 124 using, for example, a threaded set screw, weld or solder.

At the second end of the rod member, a second stage or shelf 130 is disposed or formed. Generally, the second shelf 130 defines a diameter or width of the rod member 120 that is greater than the diameter or width of the intermediate shank portion 122. By having an enlarged second shelf 130, the axial travel of the rod member 120 through the tubular assembly 110 can be limited so as to prevent over travel of the gasket 20 within the adapter 10 and thus properly locate the gasket member 20 within the gasket chamber 24. As seen in FIG. 1, the preferred second shelf 130 contacts the second ring component 110*b* of the tubular assembly 110 at the maximum travel of the rod member 120 to locate the gasket 20 within the fitting 10.

Figure 5:
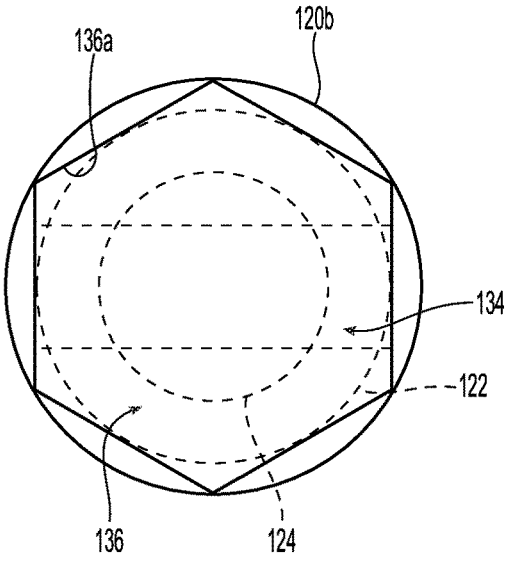
FIG. 5 is an end view of a preferred rod member for use in the gasket installation tool of FIG. 1.

As previously stated, the second end 120*b* of the rod member 120 is configured for operation by hand or a separate tool. Accordingly, the preferred shelf or stage 130 includes two or more peripherally disposed flat surfaces 132 for tool engagement. Additionally or alternatively, the shelf or stage 130 can include a through bore 134 for receipt of a rod or other handle device to assist in manipulation of the rod member 120. In another preferred aspect, the shelf or stage 130 can include a tool engagement receptacle 136. Shown in FIG. 5 is an end view of the rod member 120 and the preferred stage 130. The receptacle 136 preferably includes receptacle surface 136*a* having a plurality of radially disposed flats for contact with complementary flat surfaces of the tool.

In a preferred method of installing an annular gasket member 20 in a preferred sprinkler head fitting 10 using the preferred tool. As seen for example in FIG. 2B, the tool 100 is brought into engagement with the fitting 10 having an empty gasket chamber 24 such that the fitting 10 is received in the receptacle 116. Within the exposed portion of the passageway 111 between the housing component 110*a* and the ring component 110*b*, the gasket member 20 is loaded and engaged by the rod member 120 with the centering post 124 within the gasket member 20 and the first stage or shelf 126 supporting the gasket member in an axial centered orientation with respect to the longitudinal axis A-A so as to be preferably perpendicular and disposed about the longitudinal axis A-A. The rod member is then axially advanced to introduce the gasket member 20 into the tapered portion of the passageway 111 of the housing component 110*a* to radially compress the gasket member. With the gasket compressed, the rod member 120 is further advanced to eject the gasket member 20 from the outlet 111*b* of the housing and introduce the gasket into the fitting 10. The rod member 120 continues to axially advance preferably by threaded engagement with the ring member 110*b*. The axial advancement is limited and stopped by the engagement or contact between the ring member 110*b* and the second shelf or stage 130. Given the preferred spacing between the housing component and the ring member 110*a*, 110*b*, the termination of the rod axial advancement locates the gasket member 20 within the chamber 24 of the fitting 10, as seen for example, in FIG. 1. Therein the gasket member 20 radially expands to form a fluid tight seal with a sprinkler head installed received within the adapter.

For the preferred installation tool 100, the axial travel of the rod member 120 is controlled by the axial spacing between the housing and ring components 110*a*, 110*b* of the tubular assembly 110. For the preferred embodiment, the axial spacing is defined by the geometry of both the adapter 10 and the rod member 120. With reference to FIGS. 1 and 2A-2B, the adapter 10 defines an entrance distance E which is the minimum distance the gasket 20 must clear to be located within the gasket chamber 24. Generally, the distance E is measured from the end face of the fitting 10 to the floor of the gasket chamber 24. In the rod member 120, each of the first and second shelves 126, 130 are shown as being at a fixed location with respect to the remainder of the rod member 120 to define a shelf separation distance L1. When the rod member is fully advanced, the first shelf 126 is preferably even with the floor of the gasket chamber 24 and the second shelf 130 is in contact with the ring member 110*b*. As seen in FIG. 1, given the entrance distance E and the shelf separation distance L1, the floor of the receptacle 116 about the outlet 111*b* and the end face of the ring member 110*b* about the inlet 111*a* in the tubular assembly are preferably linearly spaced by a distance L2 to be equivalent to the differential between the shelf separation distance L1 of the rod member 120 and the fitting entrance distance E. Thus, for the preferred tool 100, the difference between the shelf separation distance L1 and the receptacle floor-to-inlet end face distance L2 is preferably equal to the entrance E distance of the fitting 10 into which the gasket member 20 is to be installed: L1−L2=E. For the preferred tubular assembly 110, the desired receptacle floor-to-inlet end face distance L2 is preferably defined or controlled in part by the axial length of the spacers 150*a*, 150*b* of the assembly 110. In an alternate arrangement, the first and second shelves 126, 130 could be adjustably located along the length of the rod member 120 and secured in place using a fastener such as a set screw provided the adjustment limits the axial advancement of the rod member 120 within the fitting 10 to avoid over travel.

Referring again to FIGS. 6A and 6B, shown is a preferred embodiment of a plastic adapter 10 for use with the installation tool 100. Preferred embodiments of the adapter 10 are shown in PCT International Patent Application Publication No. WO2017/214418, entitled "Sprinkler Head Adapter," which is incorporated by reference in its entirety. The preferred adapter 10 is preferably formed by the assembly of two components or members 12*a*, 12*b*. The first member 12*a* includes the first gasket bearing surface 28 and the second member 12*b* includes the second gasket bearing surface 30. When the second member 12*b* is coupled to the first member 12*a*, the first and second gasket bearing surfaces 28, 30 are axially spaced apart to form the preferred internal gasket chamber 24. One end of the first member 12*a* defines the first end 14 of the adapter 10 for connection to the fluid supply 8. At the opposite end of the first member 12*a* is a narrowed or stepped portion preferably having an external thread. The second member 12*b* includes an internal bore for receiving and engaging the narrowed portion of the first member 12*a* to couple the adapter members 12*a*, 12*b* to one another preferably by threaded engagement. The external end face 13 of the second member 12*b* abuts the installation tool 100 receptacle 116. Formed in the end face is an internally threaded discharge opening for receipt and securement of a sprinkler head 6 partially shown in FIGS. 6A and 6B.

For the preferred adapter shown, the axial distance between the end face 13 and the second gasket bearing surface 30 defines the preferred entrance distance E over which the gasket 20 is to be axially advanced for desired location within the gasket chamber 24. With the gasket 20 properly installed in a holding portion 24*a* of the gasket chamber 24, the sprinkler head 6 is inserted and secured to the adapter 10 to compress the gasket thereby forcing the gasket 20 to fill a preferred expansion portion of the gasket chamber 24*b* and form the fluid tight seal.

The first member 12*a* provides a body of the preferred fitting 10 and the second member 12*b* provides a cap threaded about the body 12*a*. Each of the body 12*a* and the cap 12*b* have a first end portion and a second end portion with a through hole or passageway extending from the first end portion to the second end portion along respective central axes of the body 12*a* and cap 12*b*. Preferably each component 12*a*, 12*b* is a monolithic plastic from the external surface to the internal surface without the need for any internal support or structure of a dissimilar material such as metal.

While the present invention has been disclosed with reference to certain embodiments, numerous modifications, alterations, and changes to the described embodiments are possible without departing from the sphere and scope of the present invention, as defined in the appended claims. Accordingly, it is intended that the present invention not be limited to the described embodiments, but that it has the full scope defined by the language of the following claims, and equivalents thereof.

What is claimed is:

1. A gasket installation tool for installing a gasket in an internal chamber of a sprinkler head fitting having a body member and a cap member coupled to one another to form a gasket chamber therebetween, the installation tool comprising:

a housing component having a first end for engaging the cap member and a second end for receiving a gasket member, the housing component having a tapered internal passageway extending from the first end to the second end along a longitudinal axis;

a ring component coupled to the housing component having an internal thread on an internal surface defining a central opening axially aligned with the internal passageway of the housing component; and a rod member having a first end and a second end with an external thread between the first end and the second end to engage the internal thread of the ring component such that the first end supports the gasket within the internal passageway of the housing for delivery to the gasket chamber of the fitting.

2. The installation tool of claim 1, wherein the ring component is axially spaced from the housing component.

3. The installation tool of claim 2, further comprising a pair of spacing members disposed about the internal passageway and the central opening to axially space the housing component and the rod member.

4. The installation tool of claim 1, wherein the rod member includes a first shelf for supporting and orienting the gasket and a second shelf for contacting the ring component and limiting axial travel of the rod member through the internal passageway.

5. The installation tool of claim 4, wherein the fitting defines an entrance distance to a bearing surface of the gasket chamber, the axial travel locating the first shelf even with the bearing surface of the gasket chamber.

6. The installation tool of claim 5, wherein the first end of the housing component defines a receptacle having a floor, the first and second shelves are axially spaced to define a first distance, the receptacle floor being axially spaced from an end face of the ring component to define a second distance, a difference between the first and second distance being equivalent to the entrance distance of the fitting.

7. The installation tool of claim 4, wherein the first end of the rod member includes a centering post and the first shelf is disposed about the centering post.

8. The installation tool of claim 1, wherein the first end of the housing component defines a receptacle for engaging the fitting.

9. A gasket installation tool for installing a gasket in an internal chamber of a sprinkler head fitting, the installation tool comprising:

a rod member for having a first end and a second end; and a tubular assembly for engaging the fitting, the tubular assembly having an inlet and an outlet, the tubular assembly defining a passageway extending from the inlet to the outlet along a longitudinal axis, the passageway including a radial loading first portion to which the gasket is loaded, the passageway including a housing second portion for housing the gasket proximate the outlet, the rod member received within the passageway for axial translation along the passageway to displace the gasket out of the passageway through the outlet and into the internal chamber of the fitting;

wherein the tubular assembly includes a first component defining a tapered portion of the passageway and a second component spaced from the first component defining a surface portion of the passageway for engaging the rod member, wherein the first and second components are spaced apart by a pair of spacer members diametrically disposed about the passageway.

10. The tool of claim 9, wherein the rod member has a first stage for supporting the gasket perpendicular to the longitudinal axis and a centering post extending from the first stage for engaging the gasket; wherein the rod member includes a second stage for contacting the tubular assembly to limit travel of the rod member in the tubular assembly.

* * * * *